US006070773A

United States Patent [19]

Pogoda

[11] Patent Number: 6,070,773

[45] Date of Patent: Jun. 6, 2000

[54] LINGERIE HANGER

[76] Inventor: Dale E. Pogoda, 31A Austain Ave., Albany, N.Y. 12205

[21] Appl. No.: 09/318,078

[22] Filed: May 25, 1999

Related U.S. Application Data

[60] Provisional application No. 60/086,789, May 26, 1998.

[51] Int. Cl.[7] ..... A47G 25/18

[52] U.S. Cl. ..... 223/88; 223/DIG. 1

[58] Field of Search ..... 223/85, 88, 92, 223/93, 91, 96, DIG. 1

[56] References Cited

U.S. PATENT DOCUMENTS

| | | | |
|---|---|---|---|
| D. 93,143 | 8/1934 | Spragg | 223/DIG. 1 |
| 1,533,805 | 4/1925 | Oliver | 211/113 |
| 2,557,627 | 6/1951 | Baril | 223/92 |
| 4,429,797 | 2/1984 | Collins | 211/119 |
| 4,593,812 | 6/1986 | Dillingham | 223/DIG. 1 |
| 4,623,079 | 11/1986 | Tendrup | 223/96 |
| 5,062,556 | 11/1991 | Willputz | 223/96 |
| 5,582,334 | 12/1996 | Blazer et al. | 223/85 |
| 5,881,931 | 3/1999 | Stanfield | 223/85 |

*Primary Examiner*—Bibhu Mohanty

[57] ABSTRACT

A horizontal base bar is constructed in both the left and right direction from the center bar of the unit. Each base bar is molded with a upward/inward curvature with the enlarged open area.

1 Claim, 2 Drawing Sheets

(FIGURE 1)
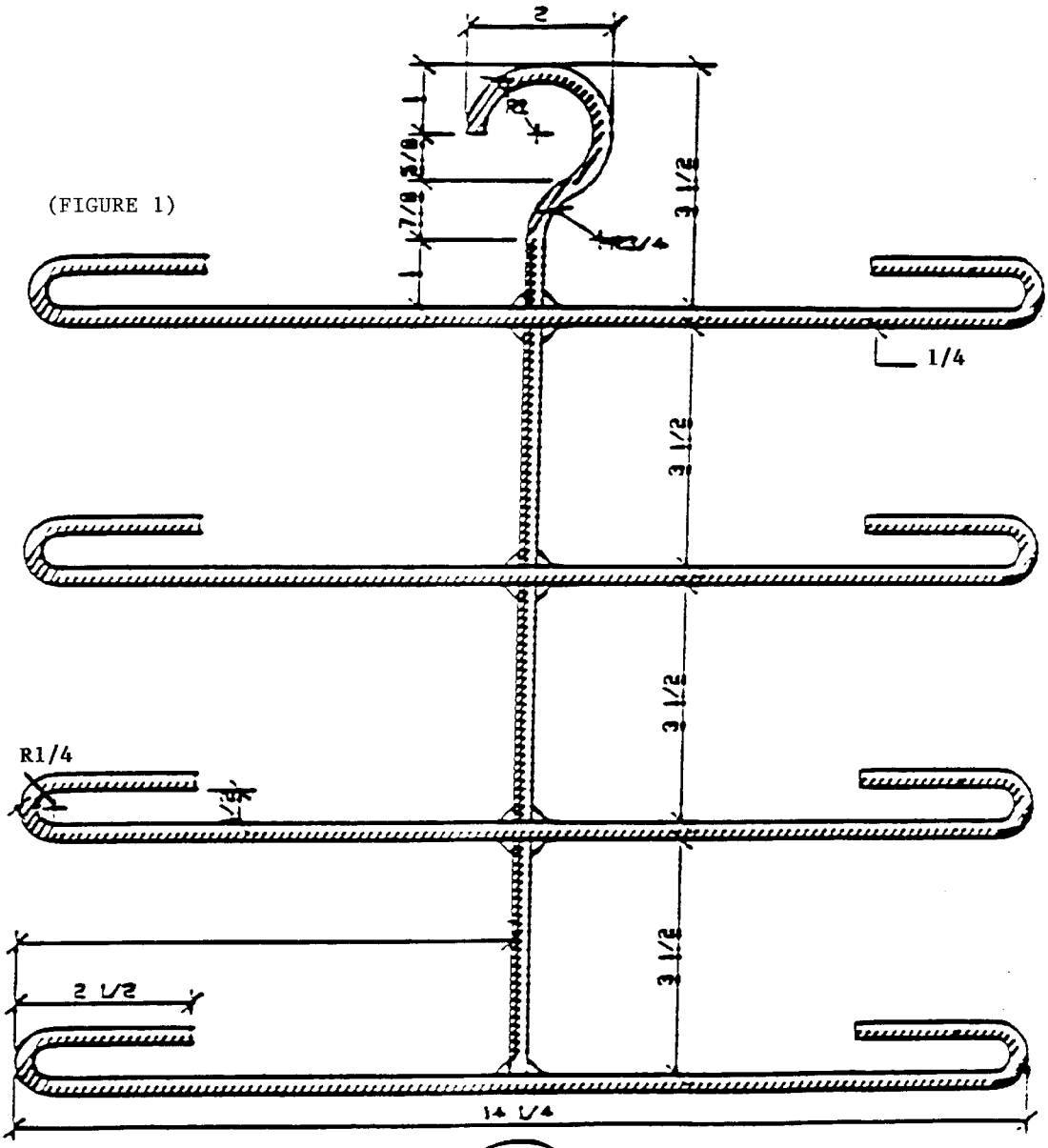
(FIGURE 2)
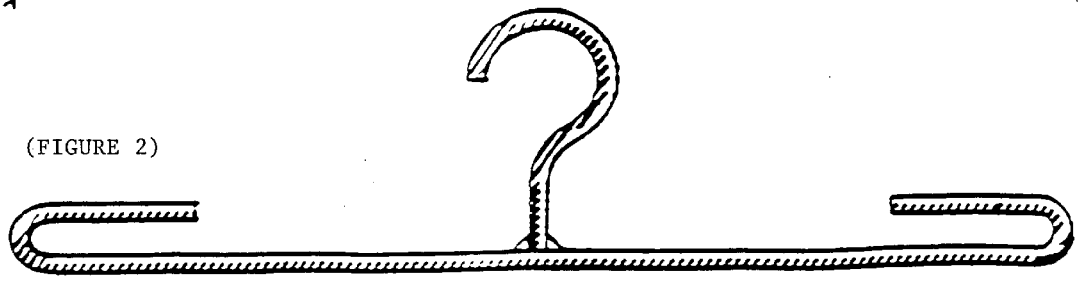

(FIGURE 3)
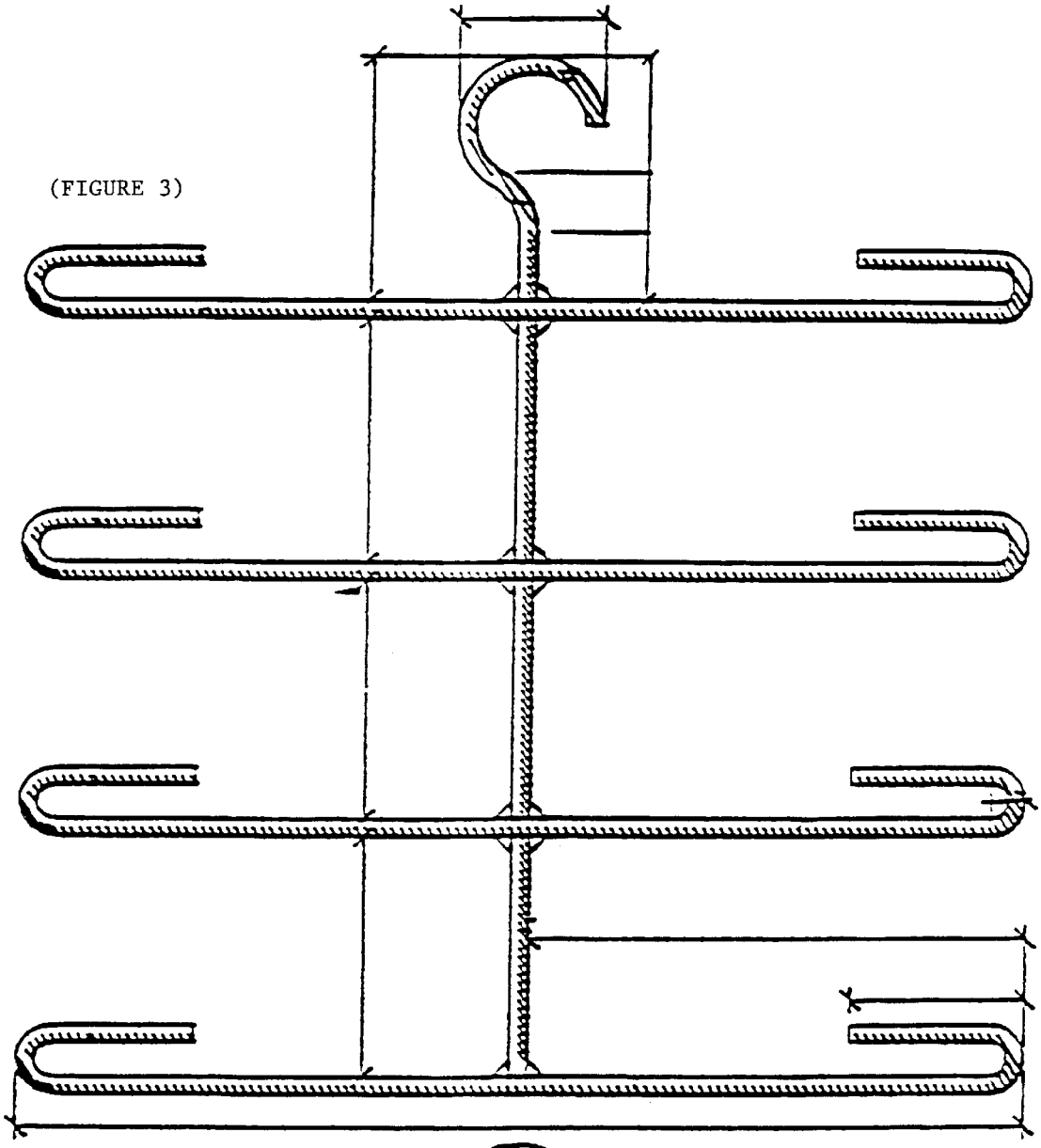
(FIGURE 4)
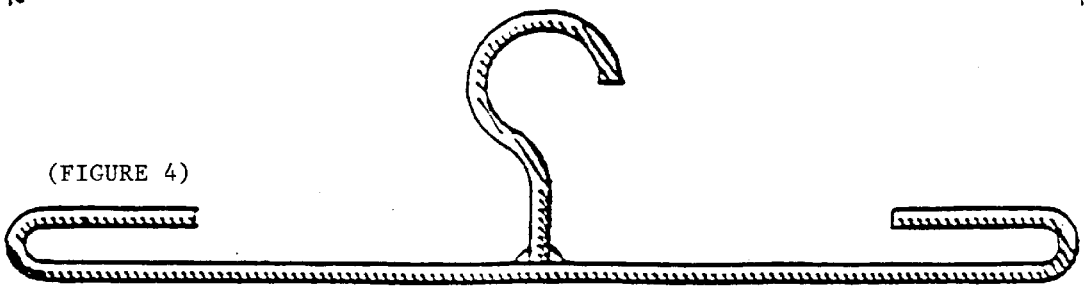

LINGERIE HANGER

This appln claims benefit of provisional appln No. 60/086,789 filed May 26, 1998.

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

BACKGROUND OF INVENTION

This invention pertains to "Hangers".

Hangers currently on the market are not designed to hold lingerie, camisoles, tank tops and tees in place. The angle at which the top of the hanger is formed causes the shoulder of the garment to slide down, resulting in the garment falling partially or completely off the hanger.

One type of hanger has been designed with extremely small hook-like formations. These formations will only accommodate the most slender shoulder strap, (i.e. spaghetti straps), not allowing for variations in shoulder widths of garments.

Another type has been designed with a small inverted opening on the both (left/right) top portions of the hanger. These openings are slightly wider than the hook-like formation, but remain to small to accommodate any garment with a wide shoulder area. They also do not accommodate any garment with significant shoulder height, such as wool, beaded vests, etc.

Neither hanger promotes ease of use.

BRIEF SUMMARY OF INVENTION

The "Lingerie Hanger" was designed specifically to handle items of apparel, which cannot be hung easily on the conventional hangers. (I.e. intimate apparel, camisoles, tank tops/tees, spaghetti strap dresses, scarves, etc.)

This unit was designed with an open horizontal bar, which rectifies multiple problems. It open area facilitates ease of placement and removal of apparel, regardless of shoulder width or height of the garment. The horizontal bar design also eliminates the downward slippage which results from the use conventional hangers.

The ends of both the left and right horizontal bar is constructed with an upward/inward curvature. The inside diameter of this curvature is approximately ½ inch wide to allow for the items of apparel with various shoulder strap width and thickness. This curvature also acts as a barrier, preventing slippage off the hanger, which results from movement of garments within the closet.

BRIEF DESCRIPTION OF DRAWINGS

FIG. 1—is a front elevation view of the multi-unit lingerie hanger showing the new functional design, which includes the left and right horizontal bar with the upward/inward curvature (dimensions included)

FIG. 2—is a front elevation view of the single lingerie hanger showing the new functional design, which includes the left and right horizontal bar with the upward/inward curvature FIG. 3—is a back elevation view of the multi-unit lingerie hanger showing the new functional design, which includes the left and right horizontal bar with the upward/inward curvature FIG. 4—is a back elevation view of the single lingerie hanger showing the new functional design, which includes the left and right horizontal bar with the upward/inward curvature

DETAILED DESCRIPTION OF THE INVENTION

From a master (prototype), construct a liquid resin silicone cavity tool. Urethane will be inserted into the silicone tool to produce the lingerie hanger (injection molding process).

The improvement is the tubular horizontal bar that extends both in the left and right direction from the center element. At the end of the right and left horizontal bar, there is an upward/inward curvature with an enlarged open area.

As seen in FIG. 1, the garment hanger has a hook portion and a vertical rod extending downward a substantial distance therefrom. A plurality of horizontal crossbars are mounted to the vertical rod. The horizontal crossbars have both ends of each crossbar curve upwardly a short distance and back a longer distance toward the vertical rod to form clips on the end of the crossbars. The garment hanger has gusset plates between the vertical rod and crossbars for rigidity.

I claim:

1. A garment hanger with a hook portion and a vertical rod extending downward a substantial distance therefrom, a plurality of horizontal crossbars mounted to the vertical rod, said horizontal crossbars having both ends of the crossbar curve upwardly a short distance and back a longer distance toward the vertical rod to form clips on the end of the crossbars, said hanger having gusset plates between the vertical rod and crossbars for rigidity.

* * * * *